United States Patent [19]

Kelly

[11] Patent Number: 4,845,488

[45] Date of Patent: Jul. 4, 1989

[54] DISPLAY DATA CONVERSION

[75] Inventor: Clifford Kelly, Goffstown, N.H.

[73] Assignee: Siemens Aktiengesellschaft, Berlin and Munich, Fed. Rep. of Germany

[21] Appl. No.: 12,762

[22] Filed: Feb. 9, 1987

[51] Int. Cl.[4] ..... G09G 1/16

[52] U.S. Cl. ..... 340/721; 340/703; 340/734

[58] Field of Search ..... 340/750, 747, 723, 519, 340/736, 722, 721, 745, 701, 703, 734

[56] References Cited

U.S. PATENT DOCUMENTS

| | | | |
|---|---|---|---|
| 3,811,040 | 5/1974 | Weinfurt | 340/736 |
| 4,209,832 | 6/1980 | Gilham et al. | 340/721 |
| 4,509,043 | 4/1985 | Mossaides | 340/747 |
| 4,599,610 | 7/1986 | Lacy | 340/721 |
| 4,613,906 | 9/1986 | Tanaka et al. | 340/721 |

OTHER PUBLICATIONS

*Digital Computer Fundamentals;* Bartee; McGraw-Hill; 1960, pp. 80—83.

*Primary Examiner*—David K. Moore
*Assistant Examiner*—Jeffery A. Brier
*Attorney, Agent, or Firm*—Lawrence C. Edelman

[57] ABSTRACT

An image display control signal is developed from a plurality of bit-plane memories having digital image data stored therein, by applying bits corresponding to the same location that are simultaneously read out from the plurality of bit-plane memories to a control input of a respective one of a corresponding plurality of switches. A digital signal representative of a display characteristic (such as intensity) for each of the bit-plane images is applied to a D/A converter for generating an analog display characteristic signal. The analog display characteristic signal for each bit-plane is applied to the signal input of a respective one of the switches. The signal output of each switch is coupled to a processing circuit which processes the analog display characteristic signals for developing the image display control signal. In a preferred embodiment, the processing comprises selecting the analog display characteristic signal corresponding to the greatest image intensity as the image display control signal.

8 Claims, 2 Drawing Sheets

DISPLAY DATA CONVERSION

BACKGROUND OF THE INVENTION

1. Field of the Invention

The present invention relates to conversion of digital data to analog form for application to a display device for forming an image thereon and more particularly, to developing an analog intensity signal from digital data for forming an image on a display.

2. Description of the Prior Art

Digital data used for forming images on video displays e.g., cathode ray tubes (CRT's), typically represent intensity information for each separate point on the scanned raster of the video display. This digital data is coupled through a digital-to-analog (D/A) converter to generate an analog voltage which is applied to the electron gun of the CRT for controlling the intensity of each point in the scanned raster. A typical prior art circuit for accomplishing this is shown in FIG. 1. Included in FIG. 1 are memory planes 12, 14 and 16, a look-up table 18 and a D/A converter 20. In an embodiment for driving a black and white display, each memory plane 12, 14 and 16 corresponds to a separate and distinct intensity level of an image to be displayed and contains a "bit-map" (a pattern of ones and zeros) of an entire image to be displayed for that respective intensity level. Bits corresponding to the same location of the bit-map for each plane, are simultaneously coupled to the addressing inputs of look-up table 18. Table 18 is preloaded via a central processor (not shown) with a distinct multi-bit number representative of a given intensity, for each combination of bits by which it can be addressed. For example, although in the FIG. 1 embodiment only 8 memory locations can be addressed by the three-bit address, if the multi-bit numbers stored in look-up table 18 have 8 bits each, the addressing selects 8 out of a possible 256 different intensity levels. The data loaded into look-up table 18 causes its output to correspond to the intensity level of the brightest (most intense) of the memory planes, for each bit of the bit-map. Thus, output intensity levels for each location of the "composite" or combined bit-map are sequentially provided to D/A converter 20 for conversion to an analog voltage. Since D/A converter 20 must determine an analog voltage for each point of the bit-map, it must operate at a relatively fast rate, e.g., 50 MHz.

It should be noted that in a prior art embodiment having a color display, three circuits of the type shown in FIG. 1 would be used, one for generating each of red, green and blue intensity signals, which signals would be applied to respective ones of red, green and blue drive circuits of a color CRT. Thus, three high-speed D/A converters would be required.

D/A converters which operate at such high speeds are relatively expensive as compared to D/A converters which operate at much slower speeds, e.g., 500 KHz. Additionally, fast D/A converters have greater power consumption as compared to slower D/A converters.

It is desirable to reduce the cost and power consumption of D/A converter circuits used in digital data conversion.

SUMMARY OF THE INVENTION

In accordance with the principles of the present invention, an image display control signal is developed from a plurality of bit-plane memories having digital image data stored therein, by applying bits corresponding to the same location that are simultaneously read out from the plurality of bit-plane memories to a control input of a respective one of a corresponding plurality of switches. A digital signal representative of a display characteristic (such as intensity) for each of the bit-plane images is applied to a D/A converter for generating an analog display characteristic signal. The analog display characteristic signal for each bit-plane is applied to the signal input of a respective one of the switches. The signal output of each switch is coupled to a processing circuit which processes the analog display characteristic signals for developing the image display control signal. In a preferred embodiment, the processing comprises selecting the analog display characteristic signal corresponding to the greatest image intensity as the image display control signal.

With the arrangement of the invention relatively slow speed D/A converters can be used, since the image display characteristic, such as intensity, is used e.g., as a warning indication, and therefore is relatively slow changing.

Other features and advantages of the invention will be apparent from the following description and the claims.

For a fuller understanding of the present invention, reference should now be made to the detailed description of the preferred embodiment of the invention and the accompanying drawings.

DETAILED DESCRIPTION OF THE INVENTION

Figure 1:
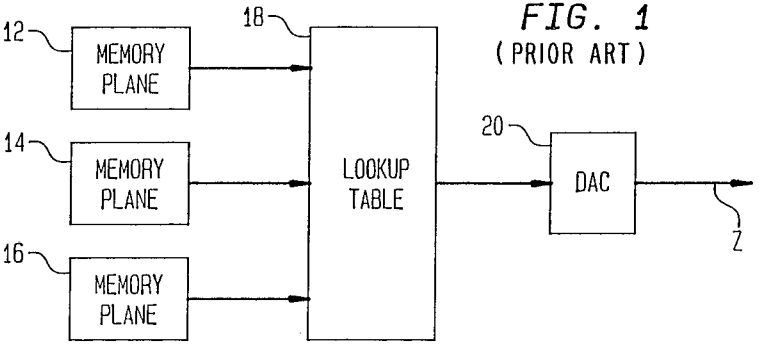
FIG. 1 (PRIOR ART)
FIG. 1 illustrates the previously described prior art D/A converter arrangement for display data.
Figure 2:
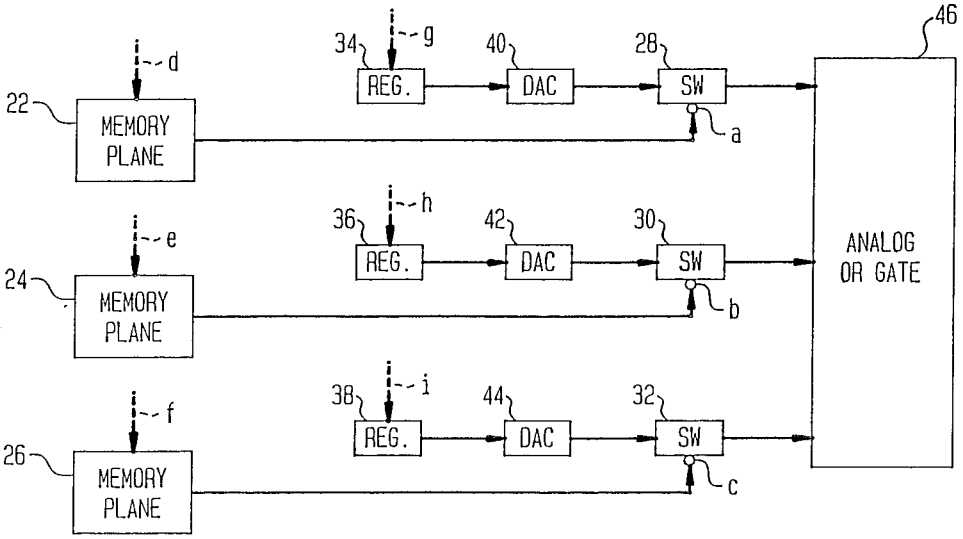
FIG. 2 illustrates a D/A converter arrangement in accordance with the present invention.

FIG. 2 illustrates a digital data conversion circuit arrangement according to the invention using relatively slow speed D/A converters. Memory planes 22, 24 and 26 each contain a bit-map of an imaged to be displayed, loaded therein via respective inputs d, e and f using a central microprocessor, not shown, just as previously described with respect to FIG. 1. However, the simultaneous digital signals read out of memory planes 22–26 are applied to control inputs a, b and c of respective ones of controllably conductive analog switches 28, 30 and 32. A display characteristic associated with each of the images, e.g., its intensity level, is set by loading a digital number into respective ones of digital registers 34, 36, and 38, via respective inputs g, h and i using the central microprocessor. The output of each of registers 34–38 is coupled to a respective one of D/A converters 40, 42 and 44 for developing respective analog display characteristic signals which correspond to the intensity levels set by the digital numbers stored in registers 34–38, respectively. The analog signals are applied to a signal processing means 46 comprising an analog transmissive "OR" gate which passes to its output the analog signal having the greatest magnitude i.e., representative of the most intense or brightest image. The output of gate 46 is used as the intensity or "z" signal applied to an x,y,z oscilliscope type of display device (not shown) for causing the image defined by the combined bit-maps of memory planes 22–26 to be displayed thereon.

Figure 3:
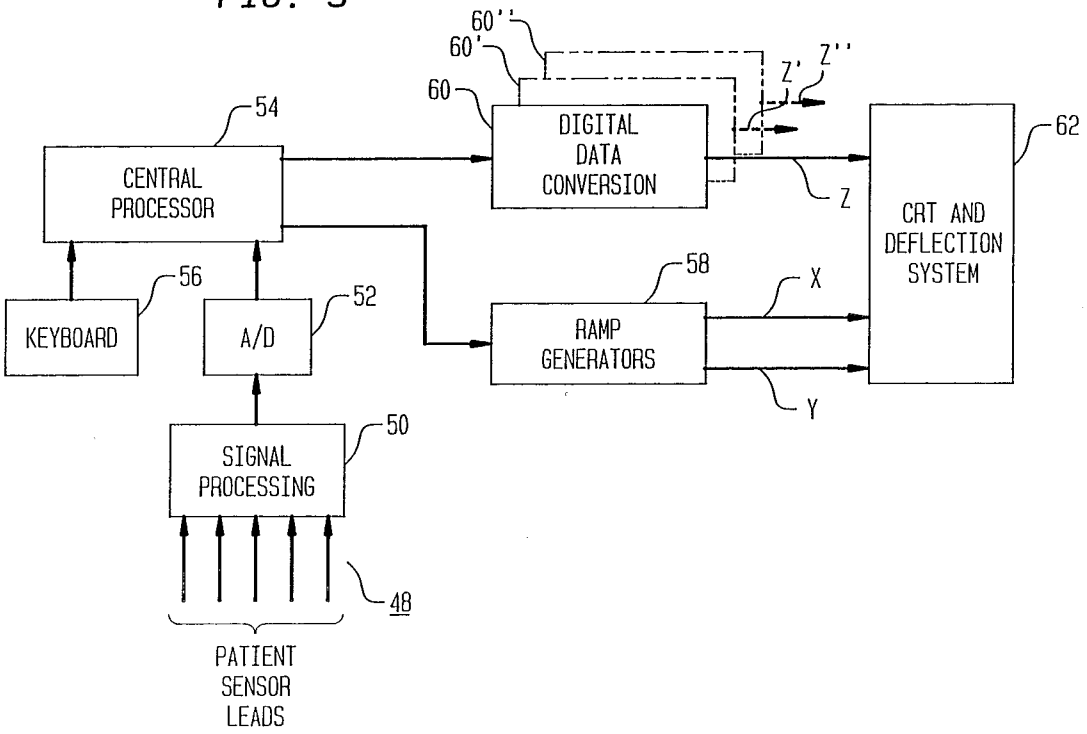
FIG. 3 illustrates a medical monitoring device for a patient which includes the D/A converter arrangement of FIG. 2.

The operation of the FIG. 2 embodiment of the invention will be described next in conjunction with FIG. 3. FIG. 3 illustrates a preferred environment for the present invention, comprising a patient monitoring device of the type used in the electro-medical field. A plurality of patient sensor leads 48, of the type well known in the art for sensing patient physiological signals such as heartbeat (EGK), blood pressure, body temperature, etc., are coupled to a patient (not shown). A signal processing stage 50 amplifies and conditions, i.e., noise filters and clamps, the analog signals supplied by sensors 48. An A/D converter 52 converts the conditioned analog signals into digital representations and applies them to a central microprocessor 54. A user/operator enters instructions into processor 54 via a keyboard 56 for controlling the processing and display of the physiological signals sensed from the patient. In accordance with the instructions received from keyboard 56, processor 54 applies digital signals to ramp generator circuits 58 for generating x and y deflection signals, and applies digital signals to digital data conversion circuitry 60, which corresponds to the circuit arrangement of FIG. 2, for generating the intensity "z" control signal. The x and y deflection signals are applied to a CRT and deflection system 62 in synchronism with the intensity "z" control signal for reproducing images of the sensed physiological signals thereon, along with associated alphanumeric and graphic symbols which are also supplied from processor 54.

In a preferred embodiment, processor 54 loads a bit-map representative of the sensed physiological signals into memory planes 22 and 24 and a bit-map representative of associated alphanumeric and graphic symbols into memory plane 26. Additionally, processor 54 loads a digital number representative of a desired display characteristic, e.g., a selected intensity level, into each of registers 34–38, for selecting the intensity of respective ones of the images represented by the bit-maps stored in corresponding ones of memory planes 22–26. The complete or composite image is generated by reading out the bit-map of memory planes 22–26 in parallel and in synchronism with the raster scanning rate of CRT 62. Thus, for each point in each of the bit-maps having a "one" stored therein, a corresponding one of switches 28–32 will become conductive and pass an intensity level representative analog signal to "OR" gate 46. As previously noted, "OR" gate 46 passes the input signal having the greatest magnitude to its output for use as the intensity "z" control signal. Thus, although the "z" signal is generated by analog signals supplied at the bit rate via switches 28–32 which must operate at a relatively fast rate, D/A converters 40–44 are allowed to operate at the much slower CRT raster scanning rate i.e., approximately 50 Hz. Thus, the relatively great expense and high power consumption characteristics of high speed D/A converters is avoided. Greater detail concerning the operation of a patient monitoring device of the type described in FIG. 3, except having a high speed D/A arrangement in place of the data conversion arrangement of the present invention, is found in U.S. Pat. No. 4,426,644 issued Jan. 17, 1984, and incorporated herein by reference.

Thus, there has been shown and described novel apparatus for developing an analog image control signal from digital data which fulfills all the objects and advantages sought therefor. Many changes, modifications, variations and other uses and applications of the subject invention will be, however, apparent to those skilled in the art after considering this specification and its accompanying drawings. For example, signal processing means 46 may comprise a combining circuit, instead of an "OR" gate, and provide at its output a signal representative of a combination of its analog input signals. Additionally, the described arrangement could advantageously be used for developing image control signals associated with a color display. For this application, the FIG. 3 arrangement would be modified to include two additional digital data conversion circuits 60' and 60'' for developing z' and z'' signals, respectively. The z, z' and z'' signals would be applied to the red, green and blue drive circuits of a color CRT, thereby controlling the formation of a color image representative of the combination of the individual bit-maps stored in circuits 60, 60' and 60''. The display characteristic selectively loaded into registers 34–38 would still be an intensity type of control signal, however, since three data conversion circuits are used, the display characteristic for circuits 60, 60' and 60'' would represent a selected intensity of a respective one of the red, green and blue colors. Another advantageous method of operation of the invention would be to change the intensity associated with one of the bit-maps when, for example, there is an alarm or warning condition. Thus, processor 54 can be instructed via keyboard 56, to cause the bit-map associated with blood pressure to become intensified if the blood pressure analog signal sensed from the patient drops to a preprogrammed minimum level. These and other modifications are considered to be within the scope of the following claims.

I claim:

1. Apparatus for generating an image-representative control signal for application to an image display, comprising:

a plurality of first means for providing a corresponding plurality of digital image signals, each digital image signal being descriptive of an individually controllable image to be displayed by said display device;

a corresponding plurality of second means for providing a respective plurality of digital characteristic signals, each digital characteristic signal being descriptive of a display characteristic for a corresponding one of said digital image signals;

a corresponding plurality of digital-to-analog conversion means coupled to corresponding ones of said plurality of second means for providing analog characteristic signals representative of said digital characteristic signals;

a corresponding plurality of controllably conductive switch means, each switch means having a control input coupled to receive the digital image signal from a respective one of said first means for controlling the conduction of said switch means, a signal input coupled to receive said analog characteristic signal from a respective one of said digital-to-analog conversion means and a signal output for providing said analog characteristic signal when said switch means is rendered conductive; and signal processing means having a corresponding plurality of signal inputs coupled to respective ones of said signal outputs of said switch means for receiving and processing each of said analog characteristic signals so as to provide at an output said image-representative control signal.

2. Apparatus according to claim 1, wherein:

said first means comprises a memory for storing a bit-map of an image to be displayed.

3. Apparatus according to claim 2, wherein:

said second means comprises a digital register for storing a binary signal representative of said digital characteristic signal.

4. Apparatus according to claim 3, further including:

control means for controlling the input of digital signals to said memory which stores said bit-map, and the input of digital signals to said register which stores said digital characteristic signals.

5. Apparatus according to claim 1, wherein:

each of said digital characteristic signals is descriptive of a display intensity for a corresponding one of said digital image signals.

6. Apparatus according to claim 5, wherein said signal processing means comprises:

a selective analog transmission "OR" circuit which provides at its output the one of said analog characteristic signals received by said signal inputs of said signal processing means which has the greatest magnitude.

7. Apparatus according to claim 1, wherein:

each of said digital characteristic signals is descriptive of a display intensity of a color of a corresponding one of said digital image signals.

8. Apparatus according to claim 1, wherein said signal processing means comprises:

a selective analog transmission circuit which provides at its output the one of said analog characteristic signals received by said signal inputs of said signal processing means which has the greatest magnitude.

* * * * *